US005895197A

United States Patent [19]

Mc Vaugh

[11] Patent Number: 5,895,197

[45] Date of Patent: Apr. 20, 1999

[54] CABLE REEL HANDLER

[75] Inventor: Arthur Kenneth Mc Vaugh, Greenlane, Pa.

[73] Assignee: Ok Champion Corporation, Hammond, Ind.

[21] Appl. No.: 08/866,848

[22] Filed: May 30, 1997

[51] Int. Cl.[6] ..... B66F 9/00

[52] U.S. Cl. ..... 414/680; 414/911

[58] Field of Search ..... 414/680, 908, 414/910, 911, 24.5, 24.6; 242/557, 403, 578, 578.1

[56] References Cited

U.S. PATENT DOCUMENTS

| | | | |
|---|---|---|---|
| 862,109 | 7/1907 | Roth | 242/578.1 |
| 3,091,413 | 5/1963 | Leithiser | 242/403 X |
| 4,460,135 | 7/1984 | Hirakawa et al. | 414/911 X |
| 4,594,041 | 6/1986 | Hostetler | 242/557 X |
| 5,456,566 | 10/1995 | Kniley et al. | 414/911 X |

*Primary Examiner*—Donald W. Underwood
*Attorney, Agent, or Firm*—Rudnick & Wolfe

[57] ABSTRACT

A cable reel handler for mounting at the rear of a truck for loading and unloading of cable reels. The handler comprises a pair of lift cylinders pivotally supported in fixed positions on the truck, a pair of lift arms pivotally connected to the truck rearwardly of the lift cylinders, and a piston and cylinder arrangement for moving the lift arms transversely whereby the spacing between the lift arms can be varied so that cable reels of different sizes can be engaged by the lift arms. A pivoting link is connected at one end to each one of the lift cylinder pistons, and each link is connected at its opposite end to one of the lift arms. The connections at each of the ends of the pivoting links comprise swivel connections whereby the loading and unloading can take place at any variation of the spacing between the lift arms. The piston and cylinder connection between the lift arms permits independent movement of the lift arms. A separate telescopic column with a ratchet and pawl mechanism extends between the lift arms to provide an interlock preventing inadvertent separation of the arms when a cable reel is attached.

19 Claims, 10 Drawing Sheets

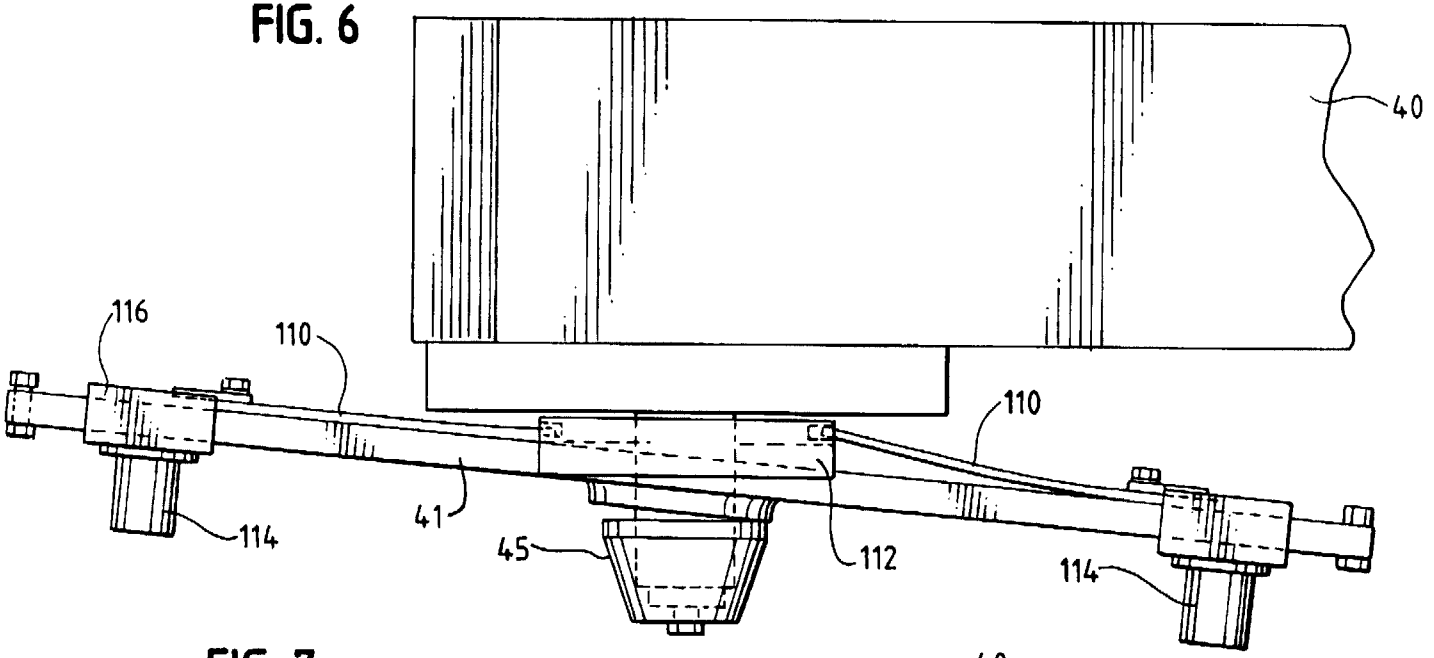
FIG. 6
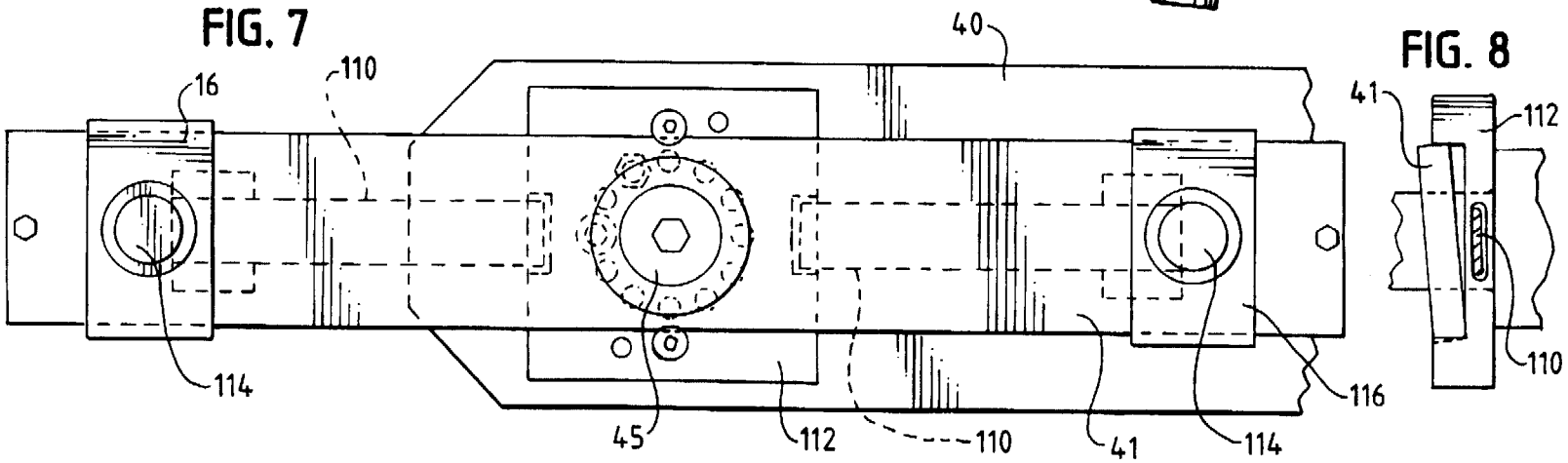
FIG. 7
FIG. 8

CABLE REEL HANDLER

BACKGROUND OF THE INVENTION

This invention relates to an improved cable reel handler.

In the installation of telephone cable and the like, it has been the practice to transport the reels on a vehicle bed. Lift mechanisms for loading and unloading the reels are preferably installed on the vehicle bed. Examples of such cable reel handling systems are found in Hall U.S. Pat. Nos. 3,184,082 and 3,325,118, and in McVaugh U.S. Pat. No. 3,820,673.

Attempts have been made to achieve versatility in the reel handlers particularly with respect to handling of reels of different widths. Such mechanisms have, however, proven to be unduly complicated with an excess of moving parts. In addition, the mechanisms require undue modification of the vehicle beds used for supporting the mechanisms and for transporting the reels.

SUMMARY OF THE INVENTION

This invention involves a cable reel handling mechanism for mounting on a vehicle bed or some other support structure. The mechanism particularly employs means permitting use in connection with the transporting of reels of different sizes and the loading and unloading of such reels to and from the truck or trailer bed.

The mechanism of the invention particularly comprises a mounting fixture positioned on the truck or trailer frame. A telescoping support cylinder is also attached to the frame, and pistons extend laterally outwardly from each end of the cylinder. Lift arms having outer ends for engagement with a cable reel are attached at the outer ends of these pistons.

Lift cylinders and associated pistons are associated with the mounting fixture at the opposite sides thereof. At the outer end of each of these pistons is attached one end of a swiveling link. The opposite ends of these links are attached, respectively, to one of the lift arms.

With this combination, the telescoping cylinder and piston is operated to vary the distance between the lift arms to accommodate reels of different sizes. Because of the swiveling links, this action of the telescoping cylinder does not affect the connection between the lift arms and the lift cylinders. Accordingly, the lift cylinders win operate in the same manner at any chosen position of the lift arms.

The mechanism of the invention also combines a safety feature which confines the lift arms against separation as the truck or trailer is transporting a cable from place to place. An interlock which operates automatically when a cable is positioned on the truck or trailer bed extends between the arms for this purpose. A pawl and ratchet-type engagement prevents movement of the arms away from each other to prevent dislodgement of the reel from the bed.

DESCRIPTION OF THE DRAWINGS

FIG. 6 is an enlarged fragmentary plan view illustrating the cable reel drive engagement means at the ends of the lift arms;

FIG. 7 is a side elevational view of the engagement means of FIG. 6;

FIG. 8 is a fragmentary cross-sectional view of the engagement means;

DESCRIPTION OF THE PREFERRED EMBODIMENT

Figure 1:
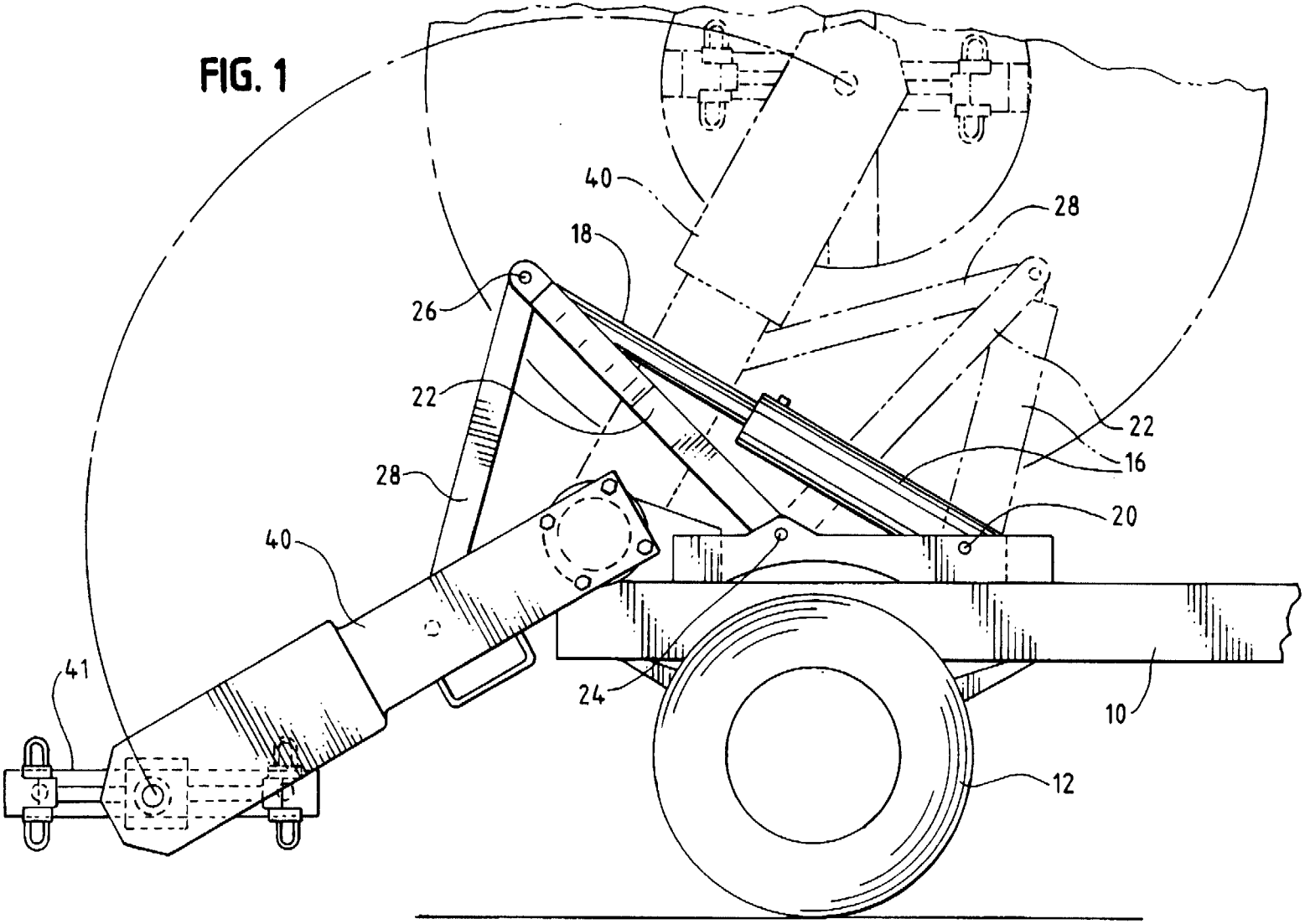
FIG. 1 is a side elevational view of the mechanism of this invention illustrating the reel lift arms in a ground level position.

The cable reel handler illustrated in the drawings is adapted for mounting on a supporting frame such as a truck or trailer frame. Aspects of the invention are also applicable to a stationary support frame located for example, in a cable salvage yard. Here, the drawings illustrate only the fragmentary section 10 of a vehicle frame along with rear wheels 12 but any suitable support frame structure may be employed.

Figure 3:
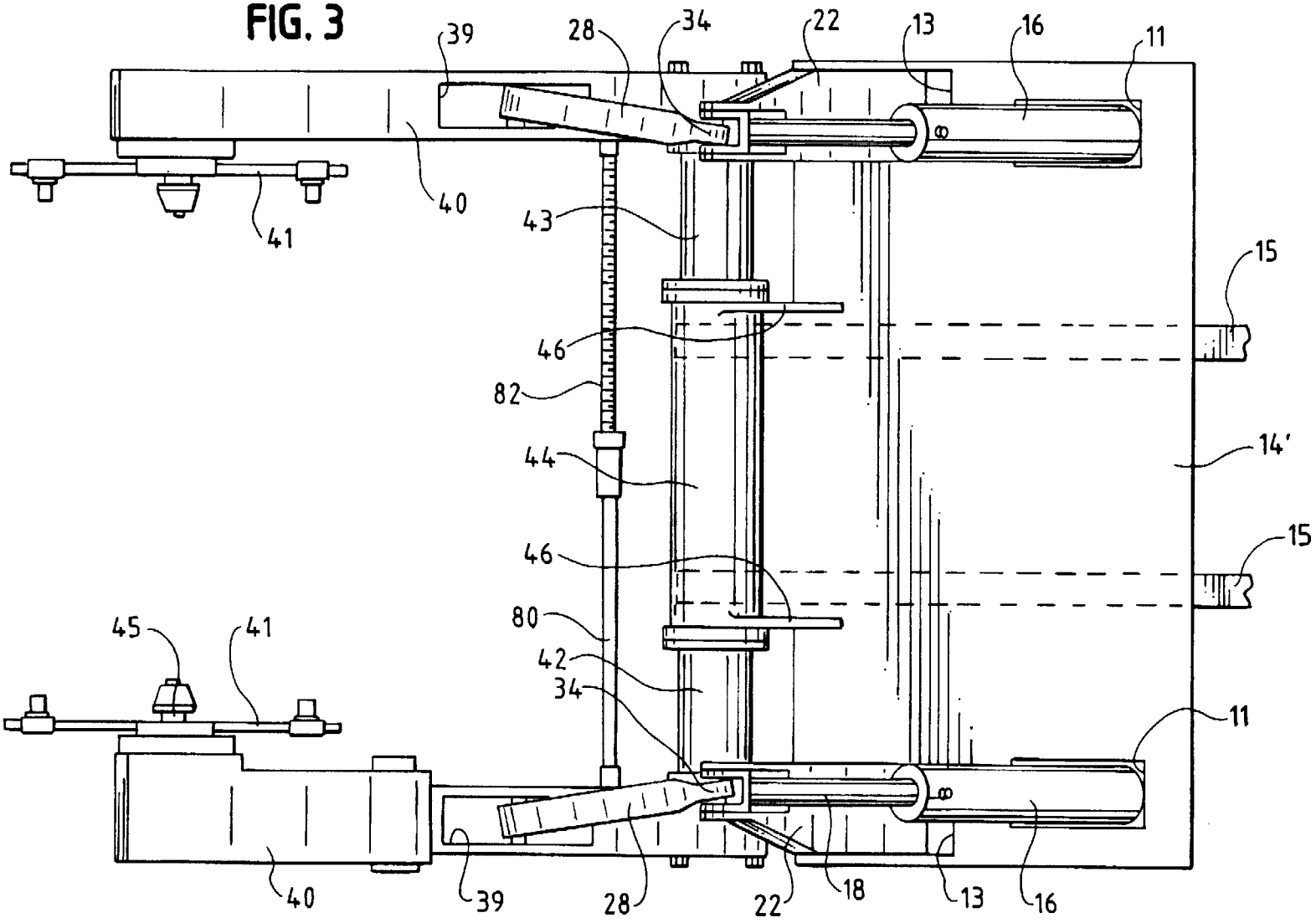
FIG. 3 is a top view of the mechanism illustrating the lift arms in position for handling a 68" cable reel.
Figure 4:
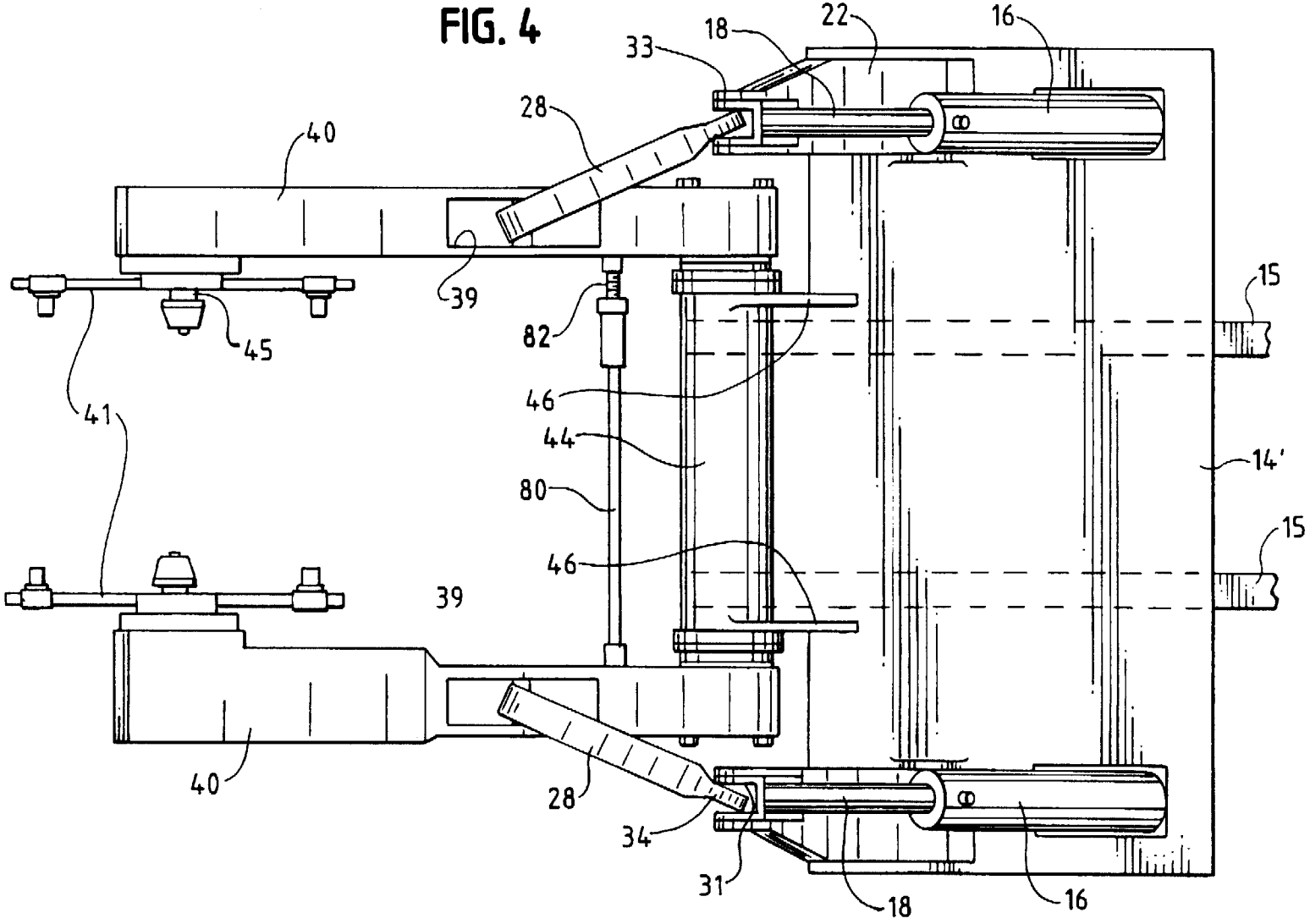
FIG. 4 is a top view of the mechanism illustrating the lift arms in position for handling a 38" cable reel.
Figure 5:
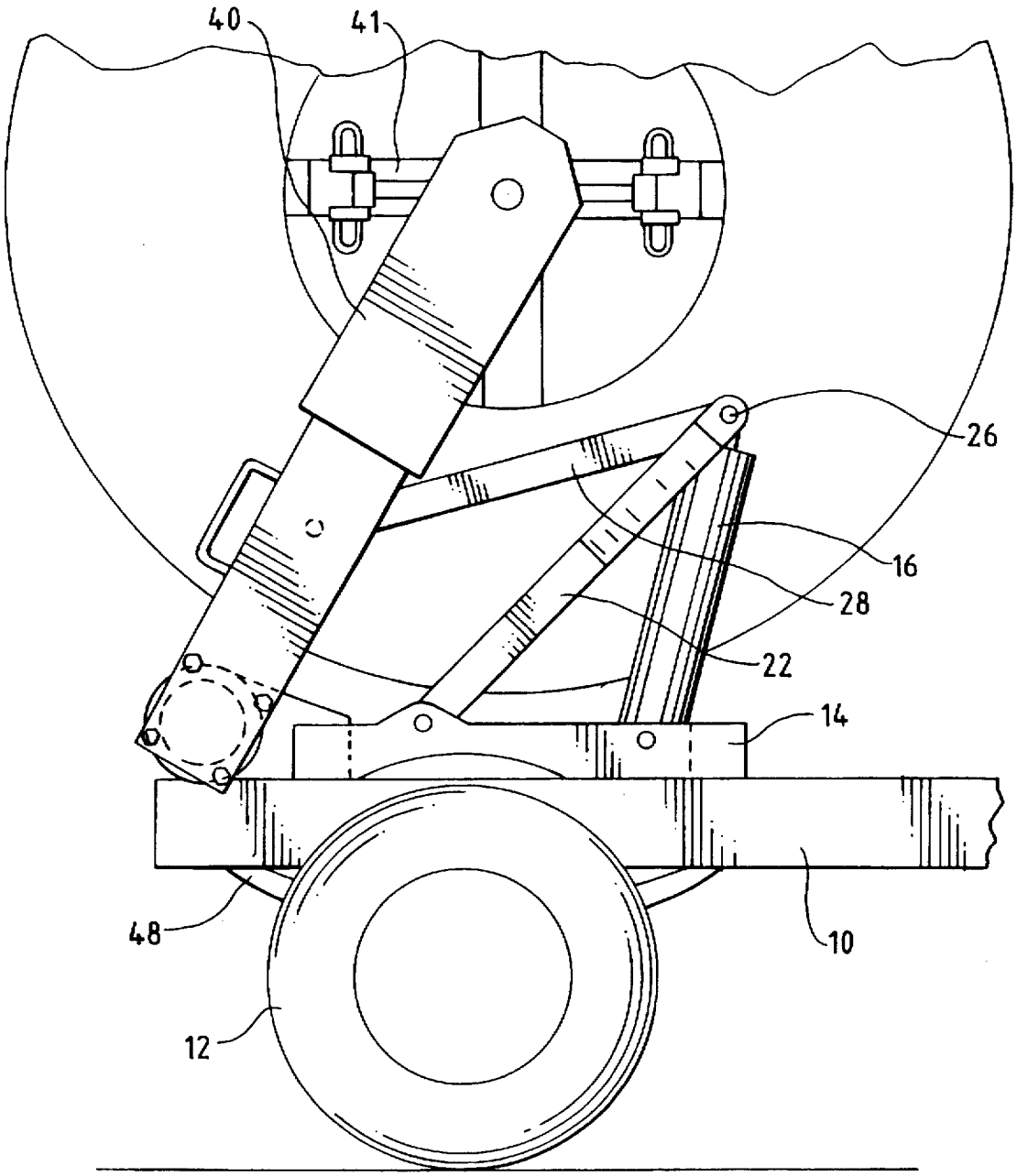
FIG. 5 is a side elevational view of the mechanism illustrating the lift arms in a reel transporting position.

The support structure may include a mounting fixture 14 mounted on the frame 10. This fixture may be covered by a rectangular plate 14' defining openings 11 and 13 on each side as shown in FIGS. 3 and 4. These openings permit the pivotal connection of operating parts of the mechanism to frame members 15 also attached to the frame.

Specifically, a lift cylinder 16 with piston 18 is pivotally attached at 20 to the fixture 14 within each opening 11. A tubular column 22 has one end pivotally connected at 24 within each opening 13 rearwardly of each pivot point 20, and the opposite end of each column 22 is pivotally connected at 26 to a swivel link 28. The tubular columns handle compression forces encountered during operation. Preferably, the columns are attached to a compression shaft so that they move in unison.

Figure 2:
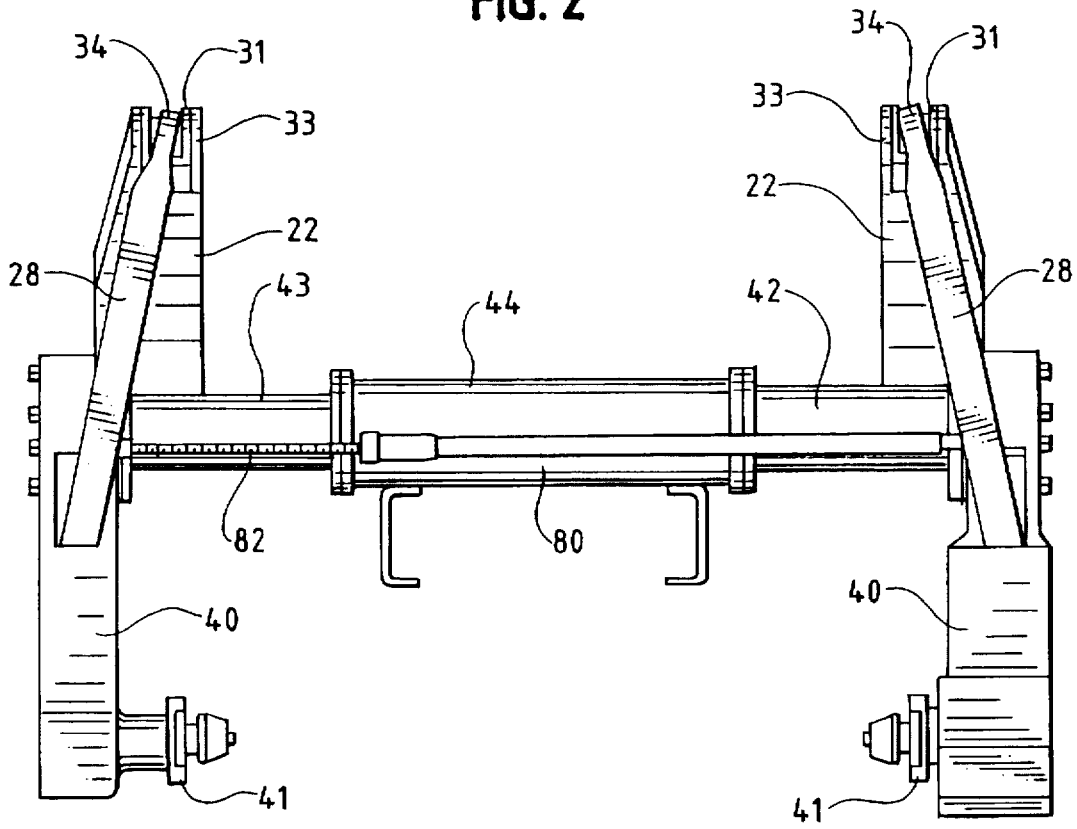
FIG. 2 is an end elevational view of the mechanism shown in FIG. 1 with the lift arms in a full open position.
Figure 11:
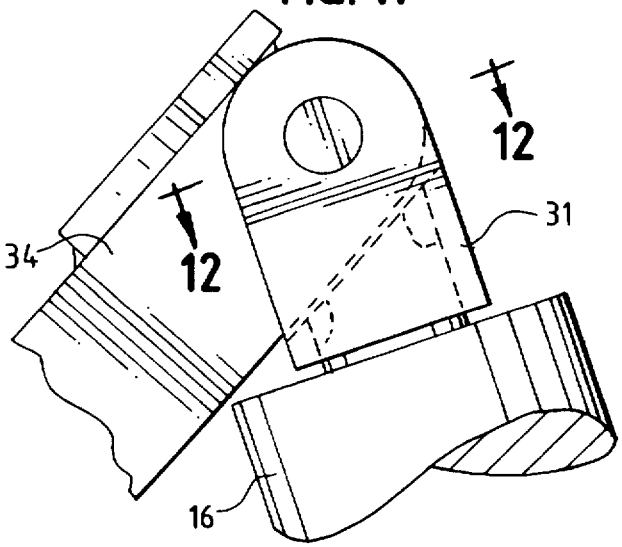
FIG. 11 is an enlarged fragmentary view of the swivel connection between the upper ends of the lift arm links and the lift pistons.
Figure 12:
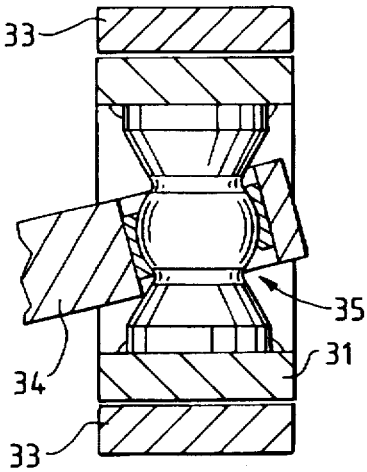
FIG. 12 is a cross-sectional view of the swivel connection in FIG. 11.

The connection of swivel links 28 permits swinging movement of the links between the positions shown in FIGS. 2, 3 and 4. Specifically, the ends 34 of the links are substantially narrower than the width of the devises 31 carried at the ends of pistons 18 (FIGS. 11 and 12). These clevises are, in turn, pivotally received within the split ends 33 of the pivot plates 22. A cylindrical bearing and sleeve connection 35 of conventional design may be used to interconnect the link arms. Accordingly, substantial freedom of movement is provided for the swivel links relative to the pistons 18 and columns 22. It will be apparent that other common linkage arrangements could be designed to achieve this swiveling action.

Figure 13:
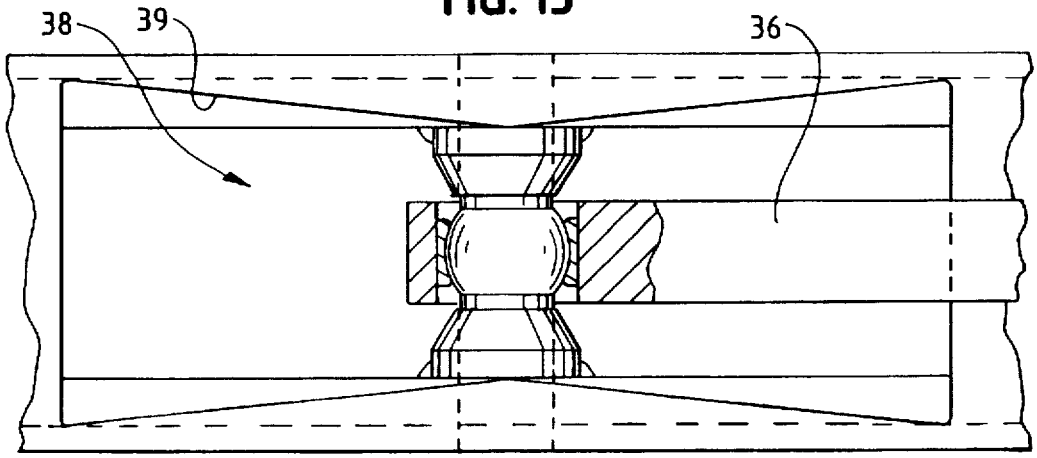
FIG. 13 is an enlarged fragmentary view of the swivel connection between the lower ends of the lift arm links and the lift arms.

The swivel links 28 each define an opposite end 36 having an opening for receiving a bearing 38 mounted in openings 39 defined in each of the reel lift arms 40. These openings are substantially larger than the width of end 36 and the bearing 38 may also be of the cylindrical bearing and sleeve type as shown in FIG. 13. Again, other connection arrangements, suitable for achieving the swiveling action, are contemplated.

The cable reel lift arms 40 may otherwise be of conventional design. The drawings illustrate, however, torque arms 41 which engage a cable reel and are driven by means described in applicant's copending application Ser. No. 08/692,380 entitled "Hydraulic Motor". As described therein, stub shafts 45 provide driving connections to the reel to achieve rotation.

The cable reel lift arms 40 are mounted on the ends of respective movable cylinders 42 and 43 which are received within telescoping cylinder 44. This cylinder is attached to the support structure, for example, longitudinal frame members 15 by means of wing elements 46 welded to the cylinder. Hydraulic lines 48 extend to the telescoping cylinder and similar lines will be connected to the lift cylinders 16 and to a hub drive as needed.

Figure 14:
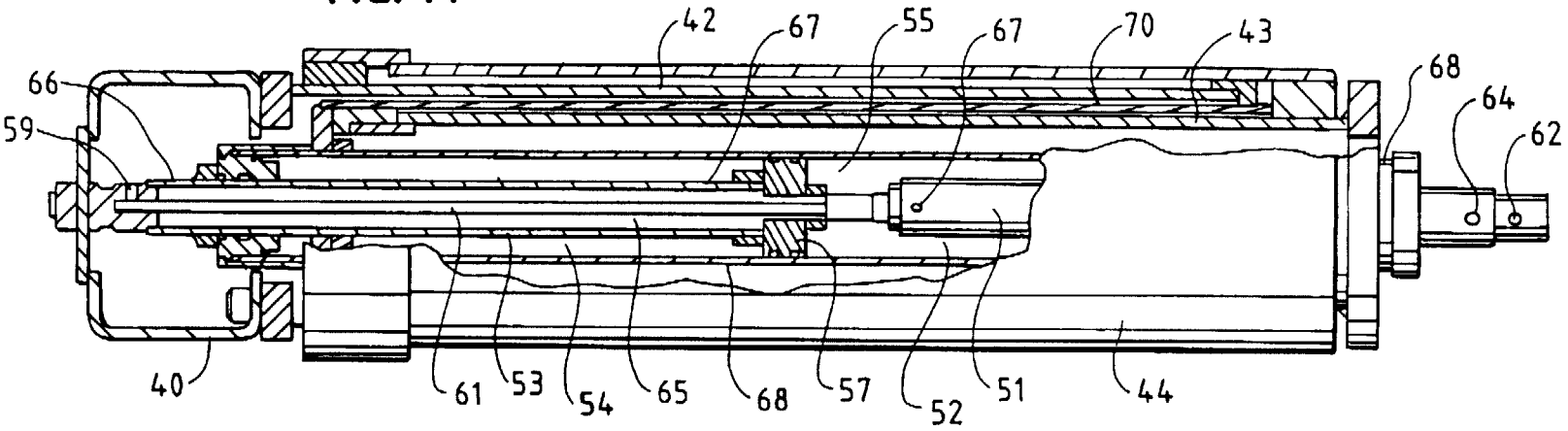
FIG. 14 is an elevational view of the telescoping cylinder and piston arrangement, partly cut away, for controlling lift arm separation.
Figure 15:
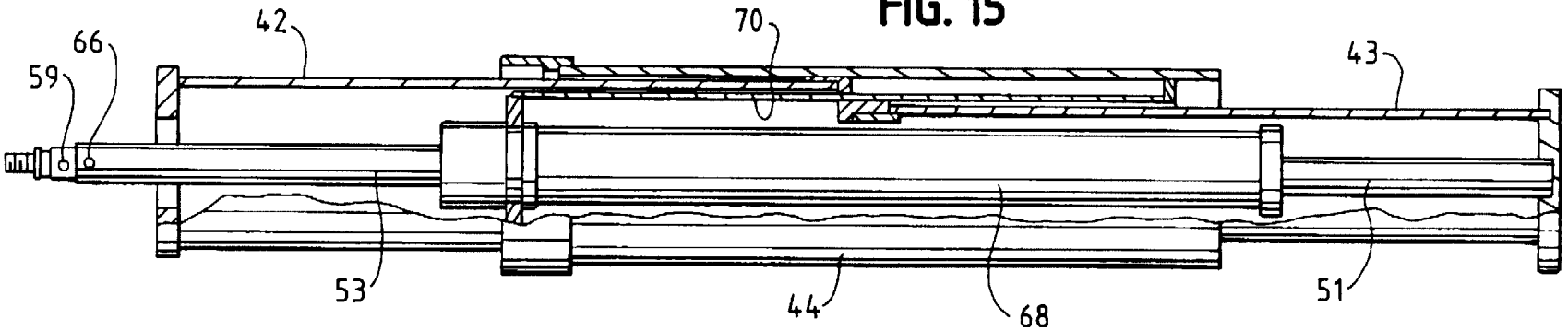
FIG. 15 is an elevational view of components of the structure of FIG. 14 in an extended position; and, FIGS. 16–21 comprise diagrammatic illustrations of the telescoping cylinder and piston arrangement in various operating stages.
Figure 16:
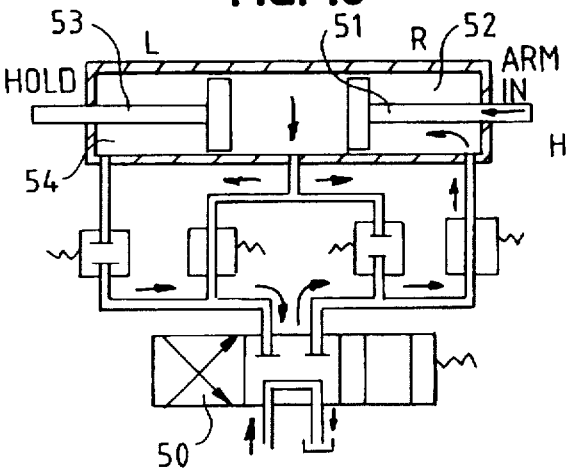
Figure 17:
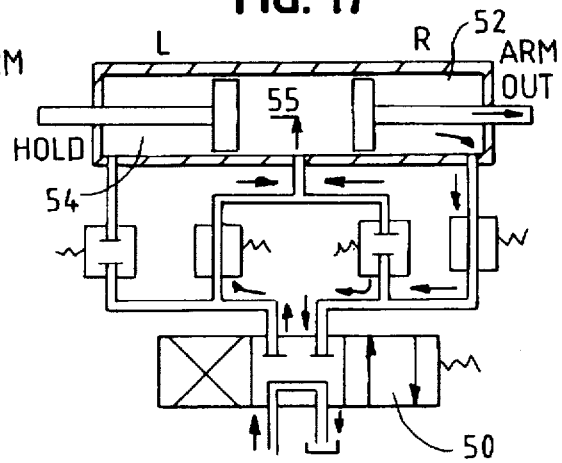

FIGS. 14 and 15 illustrate the details of the cylinder and piston design and FIGS. 16 through 21 illustrate the various operating stages which enable a great deal of operating versatility. Referring to the latter Figures, the main hydraulic control valve is illustrated schematically at 50. The arrows associated with this valve indicate flow from the hydraulic pump and back lock to the reservoir. Thus, in FIG. 16, the flow from the pump is from left to right in the diagram and the flow back is also from left to right. In FIG. 17, the flow from the pump is vertically up in the diagram and the flow back is vertically down.

With this arrangement, each piston associated with a lift arm is controlled independently of the other. In FIG. 16, the right hand piston 51 is forced inwardly since the flow from the pump to chamber 52 is unrestricted. Piston 53 does not move since flow from chamber 54 is blocked.

Figure 18:
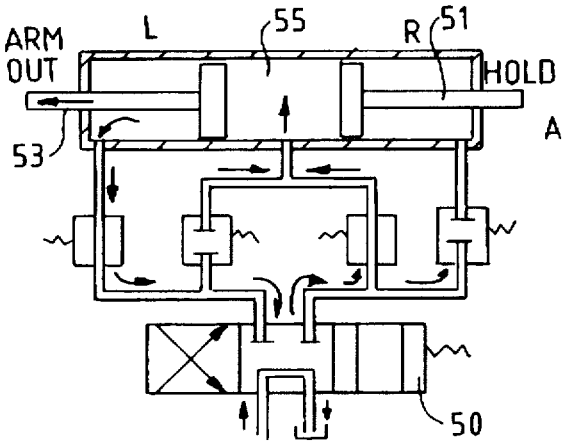
Figure 19:
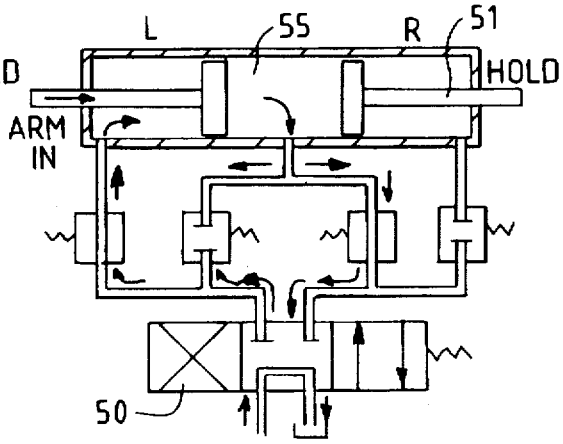

In FIG. 17, fluid is pumped to chamber 55 and piston 51 moves out but piston 53 is held stationary since flow from chamber 54 is again blocked. FIGS. 18 and 19 illustrate how movement of the piston 53 is achieved while the piston 51 is held stationary.

Figure 20:
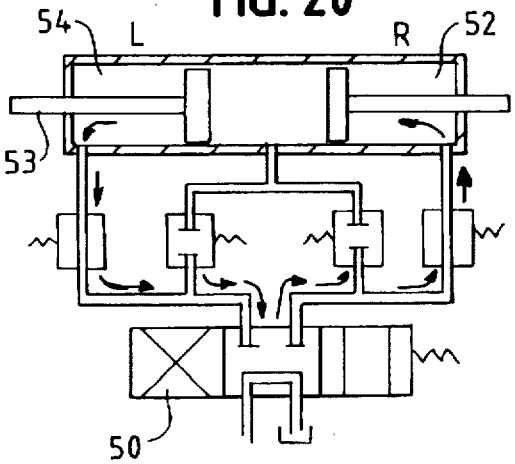

FIG. 20 illustrates the main valve 50 in the closed position which holds both pistons in a stationary position. Thus, there are no paths open between chambers 52, 54 and the pump and reservoir and this is the condition maintained when a cable reel is held between the lift arms. No separation of the arms is possible if the hydraulic system is maintained in this fashion but, as indicated above, an additional safety feature is provided as will be described hereinafter.

Figure 21:
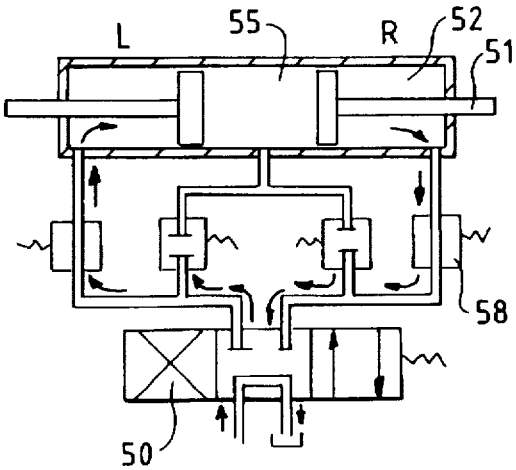

FIG. 21 illustrates the condition when simultaneous movement of the lift arms is desired. In this instance, each of the intermediate valves 56 and 58 is held open and with the main valve 50 in the position shown, the pistons 53 and 51 will both move from left to right. With the valves 56 and 58 in the open position, and with main valve 50 in the position of FIG. 1, the pistons will move together from right to left.

The described functions are achieved with input into only three chambers. Furthermore, movement of the pistons can be achieved after the cylinder is picked up and even during reeling and unreeling of cable.

FIGS. 14 and 15 illustrate the details of a telescoping cylinder arrangement which will function in the manner described in FIGS. 16–21. This arrangement consists of the stationary central cylinder 44 and the movable cylinders 42 and 43. The cylinder 42 is tied to piston rod 53 and the cylinder 43 is tied to piston rod 51. The ends of the piston rods are attached to lift arms 40 so that extension and retraction of the pistons controls the relative positions of the lift arms.

Hydraulic fluid is adapted to be introduced through opening 59 and through a passage defined by tube 61 into the chamber 55 between the piston rod ends 57. Thus, the tube passage extends within the piston interior and opens into chamber 55 for inflow of hydraulic fluid as discussed, for example, with reference to FIG. 18. Fluid is discharged from chamber 55, as shown for example in FIG. 19, through a corresponding passage in piston 51 and through opening 62 defined by that piston.

Pistons 51 and 53 also define respective openings 64 and 66 which communicate with the piston interiors 65 and with openings 67 defined by the piston walls. This results in communication with chambers 52 and 54 as discussed with reference to FIGS. 16–21. Stationary internal cylinder 68 surrounds the pistons and serves to define the chambers, 52 and 54. Intermediate stationary cylinder 70 serves to define the surface over which movable cylinder 42 moves and within which movable cylinder 43 moves.

The safety feature referred to above is provided by the location of a telescopic column including cylinder 80 and threaded rod 82 between lift arms 40. Clevises 83 are provided for attachment of the members 80 and 82 to the inside walls of the lift arms and, as shown by a comparison of FIGS. 3 and 4, the rod is adapted to extend from and retract within the cylinder depending on the spacing between the lift arms.

Figure 9:
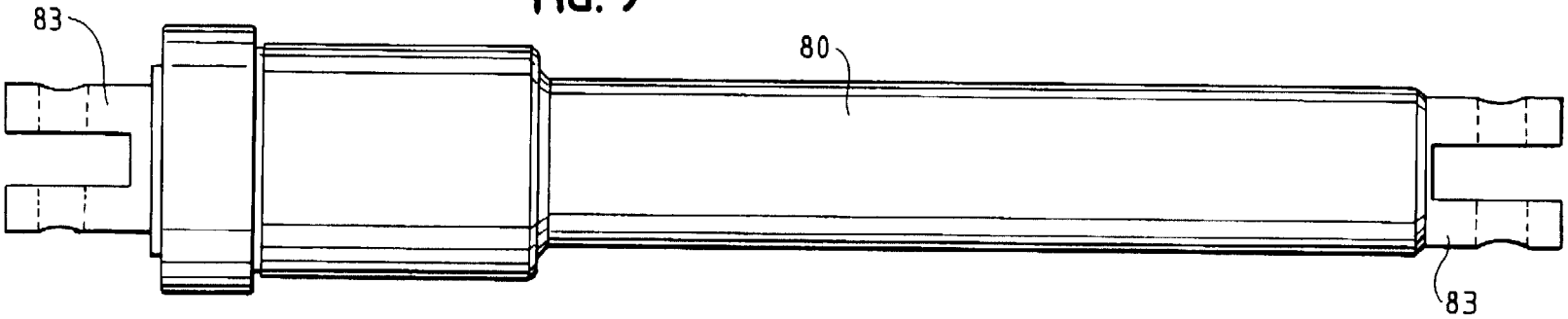
FIG. 9 is an elevational view of the lift arm safety means for preventing inadvertent separation of the lift arms.
Figure 10:
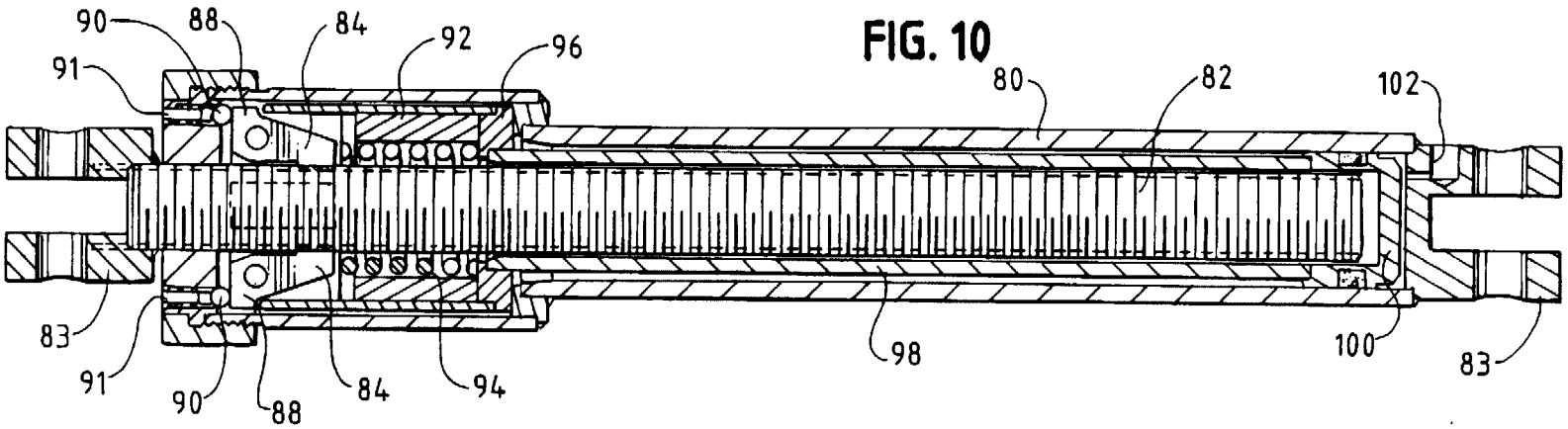
FIG. 10 is a cross-sectional view of the safety means shown in FIG. 9.

As shown in detail in FIGS. 9 and 10, rod 82 is threaded and is engaged by pawls 84. Four such pawls may be positioned at 90° intervals and each is pivotally mounted for movement of the pawl teeth into and out of engagement with the threaded rod. The opposite ends 88 of the pawls are engaged by ball bearings 90 which are continuously urged against the ends 88 by springs 91.

A cylindrical sleeve 92 is positioned for engaging the pawls to pivot the pawls out of engagement with the rod threads. This sleeve is normally forced away from the pawl ends by spring 94. The sleeve is supported on a collar 96 which is attached to another sleeve 98 located around rod 82. A cap 100 attached at the end of sleeve 98 moves in sealed relationship with the inside wall of cylinder 80. Pneumatic or hydraulic port 102 communicates with the outer surface of cap 100 whereby the application of force to the cap will push sleeve 92 against the pawl ends 88 to pivot the pawls away from the rod 82.

Figure 10A:
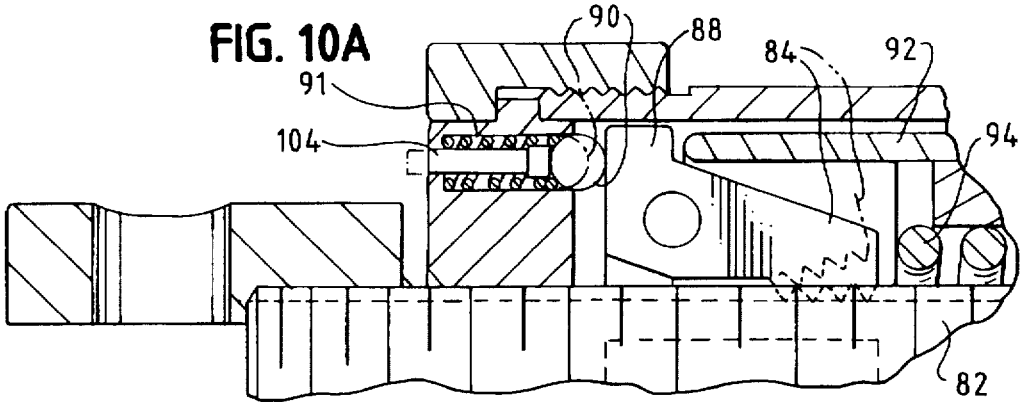
FIG. 10A is an enlarged detail fragmentary view of the safety means.

As shown in FIG. 10A, when the pawls are pivoted out of engagement, the bearings 90 are pushed into the bores occupied by springs 91. Pins 104 located within these bores are then forced outwardly and this provides a visible indication that the pawls are not engaged.

When the lift arms 40 are being pushed together, the pawls will ratchet along the rod 82. Any force which tends to separate the lift arms is, however, resisted by the pawls and the arms can only be moved apart when the sleeve 92 has been operated to release the pawls. Operation of the sleeve 92 can be tied to the hydraulic system for the cylinder 44 so that when pressure is applied to move the lift arms, the pawls will be automatically released. In addition, if the hydraulic system fails, the pawls will remain engaged.

In operation, a reel of any conventional width may be handled, such widths typically being 68" (accommodated with the configuration of FIG. 3), and 38" (accommodated with the configuration of FIG. 4). Assuming that a 68" reel is to be lifted onto a truck, the telescoping cylinder is first operated to extend pistons 42 whereby the ends of lift arms 40 may be attached to the cable reel in conventional fashion. In this regard, FIG. 2 illustrates the maximum extension of the pistons 42 which enables the ends of the lift arms to receive a reel of the largest size.

Swivel links 28 automatically allow for this movement of the pistons 42, and these links are also automatically placed in position to achieve the lifting action. Thus, operation of lift cylinders 16 retracts pistons 18, and swivel links 28 apply the force to lift arms 40 necessary to swing the reel onto the truck in the manner shown in FIG. 1. Similarly, lift cylinders 16 and swivel links 28 control operation of the lift arms during movement of a reel off of the truck onto the ground.

If a 38" reel is to be handled, the telescoping cylinder 44 is employed to move the lift arms to the position shown in FIG. 4. Again, the swivel links 28 are automatically positioned for use in connection with loading and unloading operations.

FIG. 6–8 illustrate an alternative arrangement for facilitating handling of the cable reels when the lift arms are positioned angularly relative to the side walls of a reel. This could occur when a truck or trier is backed up at an angle. There is also a tendency for the lift arms to be somewhat out of alignment with respect to each other depending upon the positions selected by the telescoping cylinder operation.

As shown in these drawings, the torque arms 41 may have leaf springs 110 attached adjacent there outer ends, and the springs may extend to a fixture 112 which is tied to the crank shaft of the hydraulic drive described in the aforementioned copending application. The arms 41 are pivotally moveable about the shaft and relative to the adjacent lift arm wall and can therefore accommodate the misaligned cable reel. Pins 114 are receivable in alignment holes typically provided in a cable reel and the pins transmit the driving force to the reels. The pins are mounted on sliding brackets 116 to accommodate different reels.

The mechanisms illustrated are highly reliable and efficient since fewer moving parts are involved when compared with constructions now in use. Less modification of a truck or trailer used for transporting the reels is also involved thereby enhancing the utility of the invention.

It will be understood that various changes and modifications of the invention may be undertaken without departing from the spirit of the invention particularly as defined by the following claims.

I claim:

1. A cable reel handler mounted on a support, whereby a cable reel can be loaded onto the support and lifted off of the support onto the ground, said handler comprising a pair of spaced-apart lift arms having means for engaging a reel, a telescoping cylinder mounted on said support, a pair of pistons associated with said telescoping cylinder, one piston having an outer end extending from one end of the cylinder and the other piston having an outer end extending from the other end of the cylinder, the pistons being adapted to be extended and retracted by said cylinder, one of said lift arms attached at the outer end of each of said pistons whereby the spacing between the lift arms is varied as the pistons extend and retract, lift cylinders and piston means for the lift cylinders, said lift cylinders being mounted for pivoting movement on the support and being fixed against movement transverse of the support, and a pair of swiveling link means each having one end attached to a lift arm and an opposite end attached to said piston means of said lift cylinders, and including a pair of tubular columns each having one end pivotally mounted on said support and an opposite end providing means attaching said swiveling link means to said piston means of said lift cylinders, whereby operation of said lift cylinders will raise and lower said lift arms at all variations of the spacing between the lift arms.

2. A cable reel handler according to claim 1 wherein said telescoping cylinder and said lift cylinders comprise hydraulic cylinders.

3. A cable reel handler according to claim 1 including a truck or trailer frame, and wherein said support comprises a mounting fixture supported by said frame, said lift cylinders, and said tubular columns being attached to said mounting fixture.

4. A cable reel handler according to claim 1 comprising a rear edge defined by said support, said telescoping cylinder being mounted at said rear edge.

5. A cable reel handler for mounting on a support whereby a cable reel can be loaded onto the support and lifted off of the support onto the ground, said handler comprising a pair of spaced-apart lift arms having means for engaging a reel, a telescoping cylinder mountable on said support, a pair of pistons associated with said telescoping cylinder, one piston having an outer end extending from one end of the cylinder and the other piston having an outer end extending from the other end of the cylinder, the pistons being adapted to be extended and retracted by said cylinder, one of said lift arms attached at the outer end of each of said pistons whereby the spacing between the lift arms is varied as the pistons extend and retract, lift cylinders mountable on said support, piston means for the lift cylinders, and a pair of swiveling link means each having one end attached to a lift arm and an opposite end attached to said piston means of said lift cylinders, and including a pair of tubular columns each having one end pivotally mountable on said support and an opposite end providing means attaching said swiveling link means to the lift cylinder piston means of said lift cylinders, said lift arms each defining means for receiving said one end of one of said swiveling link means, said one end having freedom for swiveling movement relative to said means for receiving, whereby operation of said lift cylinders will raise and lower said lift arms at all variations of the spacing between the lift arms.

6. A cable reel handler according to claim 5 wherein said tubular columns each define an end opening for receiving said opposite end of one of said swiveling link means, each said opposite end being substantially smaller in size than each said end opening for freedom of swiveling movement within each said end opening.

7. A cable reel handler for mounting on a support for loading and unloading of cable reels, said handler comprising a pair of lift cylinders pivotally supportable in fixed positions on the support, a pair of lift arms pivotally connectable to the support rearwardly of said lift cylinders, means connected between said lift arms for moving said lift arms transversely whereby the spacing between the lift arms can be varied so that cable reels of different sizes can be engaged by the lift arms, pistons for said lift cylinders, and a pair of link means, each link means being connected at one of its ends to one of said pistons, and each link means being connected at its opposite end to one of said lift arms, a pair of tubular columns each having one end pivotally mountable on said support, and each having an opposite end providing means attaching said link means to said pistons for said lift cylinders, the connections at each of the ends of the link means comprising both pivotable and swivel connections whereby the loading and unloading can take place at any variation of the spacing between the lift arms.

8. A cable reel handler according to claim 7 wherein said means for moving said lift arms transversely comprises a telescoping cylinder mountable at the rear of said support and extending transversely thereof, pistons movable relative to each end of the telescoping cylinder, and means for attaching the telescoping cylinder pistons to said lift arms.

9. A cable reel handler according to claim 8 comprising means for applying pressure to one of said pistons, and separate means for applying pressure to the other of said pistons so that the pistons can be operated independently of each other.

10. A cable reel handler for mounting on a support for loading and unloading of cable reels, said handler comprising a pair of lift cylinders pivotally supportable in fixed positions on the support, a pair of lift arms pivotally connectable to the support rearwardly of said lift cylinders, means connected between said lift arms for moving said lift arms transversely whereby the spacing between the lift arms can be varied so that cable reels of different sizes can be engaged by the lift arms, pistons for said lift cylinders, and a pair of link means, each link means being connected at one of its ends to one of said pistons, and each link means being connected at its opposite end to one of said lift arms, a pair of tubular columns each having one end pivotally mountable on said support, and each having an opposite end providing means attaching said link means to said pistons for said lift cylinders, the connections at each of the ends of the link means comprising both pivotable and swivel connections whereby the loading and unloading can take place at any variation of the spacing between the lift arms, and including a separate cylinder and piston rod extending between said lift arms, and ratchet and pawl means connected to the separate cylinder and rod permitting movement of the lift arms toward each other while normally locking the lift arms against movement away from each other.

11. A cable reel handler to claim 10 including means connected to the pawl means for visually indicating that the pawl means are not engaged.

12. A cable reel handler for mounting on a support for loading and unloading of cable reels, said handler comprising a pair of lift cylinders pivotally supportable in fixed positions on the support, a pair of lift arms pivotally connectable to the support rearwardly of said lift cylinders, means connected between said lift arms for moving said lift arms transversely whereby the spacing between the lift arms can be varied so that cable reels of different sizes can be engaged by the lift arms, pistons for said lift cylinders, and a pair of link means, each link means being connected at one of its ends to one of said pistons, and each link means being connected at its opposite end to one of said lift arms, a pair of tubular columns each having one end pivotally mountable on said support, and each having an opposite end providing the means attaching said link means to said pistons for said lift cylinders, the connections at each of the ends of the link means comprising both pivotable and swivel connections whereby the loading and unloading can take place at any variation of the spacing between the lift arms, including arm means attached to said lift arms for engagement with said cable reels, means movably supporting said arm means on said lift arms whereby the arm means may accommodate cable reels positioned at different angles relative to the lift arms, and spring means urging the arm means into positions parallel with the cable reel.

13. A cable reel handler according to claim 12 including means driving said arm means for rotation of said cable reels.

14. A cable reel handler of the type comprising a frame and cable reel lift arms pivotally connected to the frame whereby a cable reel positioned away from the frame can be grasped by the lift arms and moved onto a supporting bed defined by the frame, and whereby a cable reel supported on said bed can be moved off the bed to a position away from the frame, said lift arms being maintained in a spaced-apart, parallel relationship, and means for moving said lift arms transversely toward and away from each other to permit grasping of cable reels of different sizes, and including cylinder and piston means mounted on the frame for pivoting the lift arms, the improvement comprising column means defining a bottom end and a top end, the bottom end of said column means being pivotally mounted on said frame, said piston means having outer end means pivotally attached to said column means at the top end thereof, and a pair of swivelling link means each defining first and second ends, the first end of each swiveling link means being pivotally and swivellingly connected at a column means top end, one second end of a swiveling link means being pivotally and swivellingly connected to one of said lift arms, and the other second end of the other swiveling link means being pivotally and swivellingly connected to the other of said lift arms.

15. A cable reel handler according to claim 14 wherein said means for moving said lift arms transversely comprises a cylinder mounted at the rear of said frame and extending transversely thereof, pistons movable transversely relative to each end of the telescoping cylinder, and means for attaching said telescoping cylinder pistons to said lift arms.

16. A cable reel handler of the type comprising a frame and cable reel lift arms pivotally connected to the frame whereby a cable reel positioned away from the frame can be grasped by the lift arms and moved onto a supporting bed defined by the frame, and whereby a cable reel supported on said bed can be moved off the bed to a position away from the frame, said lift arms being maintained in a spaced-apart, parallel relationship, and means for moving said lift arms transversely toward and away from each other to permit grasping of cable reels of different sizes, and including cylinder and piston means mounted on the frame for pivoting the lift arms, the improvement comprising column means defining a bottom end and a top end, the bottom end of said column means being pivotally mounted on said frame, said piston means having outer end means pivotally attached to said column means at the top end thereof, and a pair of swivelling link means each defining first and second ends, the first end of each swiveling link means being pivotally and swivellingly connected at a column means top end, one second end of a swiveling link means being pivotally and swivellingly connected to one of said lift arms, and the other second end of the other swiveling link means being pivotally and swivellingly connected to the other of said lift arms, said means for moving said lift arms transversely comprising a telescoping cylinder mounted at the rear of said frame and extending transversely thereof, pistons movable transversely relative to each end of the telescoping cylinder, means for attaching the telescoping cylinder pistons to said lift arms, means for applying pressure to one of said pistons, and separate means for applying pressure to the other of said pistons so that the pistons can be operated independently of each other.

17. A cable reel handler of the type comprising a frame and cable reel lift arms pivotally connected to the frame whereby a cable reel positioned away from the frame can be grasped by the lift arms and moved onto a supporting bed defined by the frame, and whereby a cable reel supported on said bed can be moved off the bed to a position away from the frame, said lift arms being maintained in a spaced-apart, parallel relationship, and means for moving said lift arms transversely toward and away from each other to permit grasping of cable reels of different sizes, and including cylinder and piston means mounted on the frame for pivoting the lift arms, the improvement comprising column means defining a bottom end and a top end, the bottom end of said column means being pivotally mounted on said frame, said piston means having outer end means pivotally attached to said column means at the top end thereof, and a pair of link means each defining first and second ends, the first end of each link means being pivotally connected at a column means top end, one second end of a link means being pivotally connected to one of said lift arms, and the other second end of the other link means being pivotally connected to the other of said lift arms, and including a separate cylinder and piston rod extending between said lift arms, and ratchet and pawl means connected to the separate cylinder and rod permitting movement of the lift arms toward each other while normally locking the lift arms against movement away from each other.

18. A cable reel handler of the type comprising a frame and cable reel lift arms pivotally connected to the frame whereby a cable reel positioned away from the frame can be grasped by the lift arms and moved onto a supporting bed defined by the frame, and whereby a cable reel supported on said bed can be moved off the bed to a position away from the frame, said lift arms being maintained in a spaced-apart, parallel relationship, and means for moving said lift arms transversely toward and away from each other to permit grasping of cable reels of different sizes, and including cylinder and piston means mounted on the frame for pivoting the lift arms, the improvement comprising column means defining a bottom end and a top end, the bottom end of said column means being pivotally mounted on said frame, said piston means having outer end means pivotally attached to said column means at the top end thereof, and a pair of swivelling link means each defining first and second ends, the first end of each swiveling link means being pivotally and swivellingly connected at a column means top end, one second end of a swiveling link means being pivotally and swivellingly connected to one of said lift arms, and the other second end of the other swiveling link means being pivotally and swivellingly connected to the other of said lift arms, and wherein said column means top end defines an end opening for receiving the first end of said swiveling link means, said first end being substantially smaller in size than said end opening for freedom of swiveling movement within said end opening.

19. A cable reel handler of the type comprising a frame and cable reel lift arms pivotally connected to the frame whereby a cable reel positioned away from the frame can be grasped by the lift arms and moved onto a supporting bed defined by the frame, and whereby a cable reel supported on said bed can be moved off the bed to a position away from the frame, said lift arms being maintained in a spaced-apart, parallel relationship, and means for moving said lift arms transversely toward and away from each other to permit grasping of cable reels of different sizes, and including cylinder and piston means mounted on the frame for pivoting the lift arms, the improvement comprising column means defining a bottom end and a top end, the bottom end of said column means being pivotally mounted on said frame, said piston means having outer end means pivotally attached to said column means at the top end thereof, and a pair of link means each defining first and second ends, the first end of each link means being pivotally connected at a column means top end, one second end of a link means being pivotally connected to one of said lift arms, and the other second end of the other link means being pivotally connected to the other of said lift arms, and including arm means attached to said lift arms for engagement with said cable reels, means movably supporting said arm means on said lift arms whereby the arm means may accommodate cable reels positioned at different angles relative to the lift arms, and spring means urging the arm means into positions parallel with the cable reel.

* * * * *